United States Patent [19]

Stolba

[11] 4,423,866

[45] Jan. 3, 1984

[54] GYMNASTICS/EXERCISING EQUIPMENT

[76] Inventor: Edvard Stolba, Movien 2, N-1458 Fjellstrand, Norway

[21] Appl. No.: 264,137

[22] Filed: May 15, 1981

[30] Foreign Application Priority Data

May 28, 1980 [NO] Norway ..... 801576

[51] Int. Cl.[3] ..... A63B 21/00

[52] U.S. Cl. ..... 272/125; 272/143; 272/75

[58] Field of Search ..... 272/75, 116, 125, 126, 272/133, 143, 67, 68, 137, DIG. 8

[56] References Cited

U.S. PATENT DOCUMENTS

| | | | |
|---|---|---|---|
| 385,901 | 7/1888 | Barnett | 272/137 |
| 2,643,123 | 6/1953 | Spinks | 272/68 |
| 3,117,781 | 1/1964 | Vargo | 272/125 |
| 3,204,955 | 9/1965 | Quire | 272/125 |
| 3,806,121 | 4/1974 | Crossley | 272/67 X |
| 3,910,573 | 10/1975 | Jamba | 272/125 |

FOREIGN PATENT DOCUMENTS

| | | | |
|---|---|---|---|
| 538316 | 3/1922 | France | 272/75 |
| 360453 | 11/1931 | United Kingdom | 272/67 |
| 1217867 | 12/1970 | United Kingdom | 272/75 |

*Primary Examiner*—Richard J. Johnson
*Attorney, Agent, or Firm*—Martin Smolowitz

[57] ABSTRACT

A gymnastics/exercising device for universal use, and especially for places of employment where the work entails one-sided or static strains. The equipment comprises two handles connected by an inelastic rope whose length between the handles can be varied. The end sections of the handles are expanded in relation to the middle section of the handle. The rope is secured to the middle section of the handle near one of the expanded end sections of the handle, and is intended to be wound around the middle section of the handle. One of the end sections of the handle has a larger diameter than the other. This end section has an external, annular depression therein, intended to receive and support the little finger of the user's hand during use. The other end section is provided with longitudinal flutes intended to facilitate the finger's grip when the handle is being turned.

5 Claims, 9 Drawing Figures

GYMNASTICS/EXERCISING EQUIPMENT

BACKGROUND OF INVENTION

Figure 1:
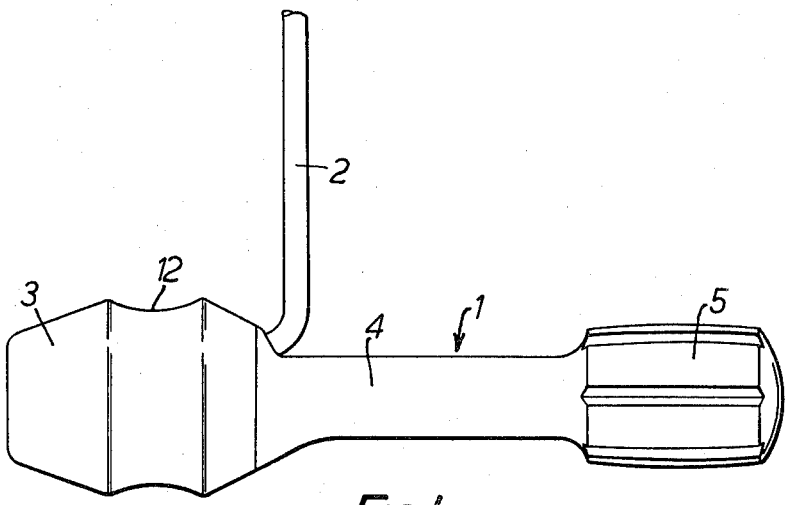

The present invention relates to gymnastics/exercising equipment comprising two elongated handles interconnected by an inelastic rope.

Over large parts of the world today, more and more work is being performed at desks, assembly benches and the like, jobs which entail one-sided and static muscular work. In such situations, the demands placed on the musculature in the neck, back, shoulders and arms may be great, and pain in these muscles is in fact one of the most common causes of absence from work owing to incapacity or illness today.

Such cases of temporary, chronic or permanent incapacity place a great burden on the public health service, which must try as best it can to give remedial treatment for the injuries which have already been incurred. Thus, it is quite clear that for the good of society as a whole as well as for the sake of the individual worker, it is most important to a far greater extent than heretobefore, to employ preventive measures to reduce the incidence and severity of this type of bodily injury.

This means that everyone who may be prone to such injuries resulting from muscle strain whould have easy and reasonable access to remedies which can help them to counteract the physical strains of their work. To this end, there are available today a number of apparatuses and devices for conditioning, exercising and gymnastics, such as, for example, wall bars, rowing machines, lifting equipment, threadmills and the like. All such apparatuses, however, have several common drawbacks: They usually take up a great deal of space, they are large and heavy and are therefore usually permanently installed at a location, and above all, they are expensive.

Moreover, almost all of the known apparatuses permit only specific forms of condition-training and also require an indoor location. As a rule, only one person at a time can use the apparatus, and the equipment is usually very specialized, making it incumbent on the user to exercise according to the specifications of the equipment and not always according to the needs he himself has. All of the above drawbacks are factors which to a great and undesirable degree have restricted and reduced the use of the devices available on the market.

Thus, there exists a distinct need for a lightweight, reasonably-priced and easily portable device which can be made available to everyone and which to as great an extent as possible can meet the individual needs of each user.

One attempt to overcome the drawbacks of prior art exercising equipment and to solve the problem mentioned above is described in U.S. Pat. No. 3,204,955, which describes an exercising device comprising an endless loop of flexible, inelastic rope, provided with two handles. This device, however, has a substantial drawback, because it is not possible to fine-adjust the device so as to adapt it to any prospective user of whatever physical size. In principle, the device disclosed in this U.S. patent specification has only three main positions, which one obtains by winding one or several loops of the rope around the handles.

In addition to meeting the needs mentioned previously, it is also very desirable and important that such exercising equipment can be finely adjusted quickly and easily to suit the individual user, whether the user be a child or an adult, a new beginner or a more practiced user.

DESCRIPTION OF INVENTION

The above conditions are satisfied in accordance with the invention by a gymnastics/exercising device comprising elongated handles interconnected by an inelastic rope whose length between the handles can be varied, and the equipment according to the invention is characterized in that respective ends of the rope are fastened to each of the handles at the middle section of the handle, said section having a smaller cross section than the end sections of the handle.

Figure 2:
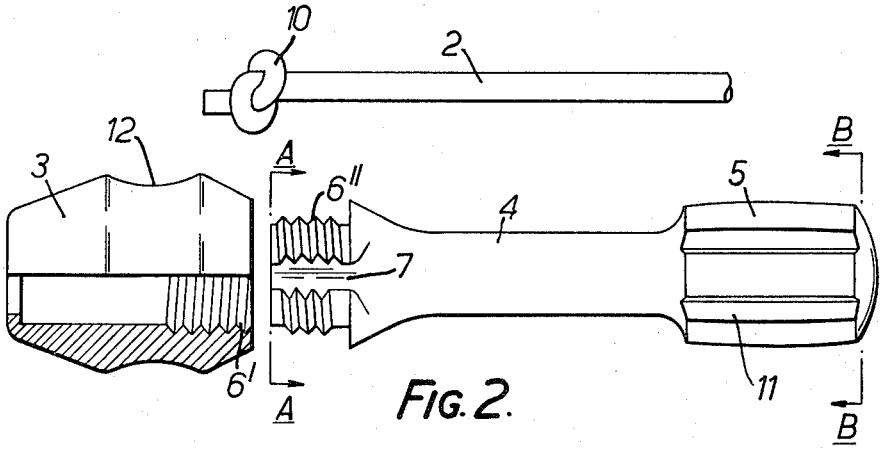
Figure 3:
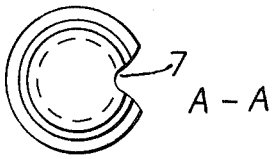
Figure 4:
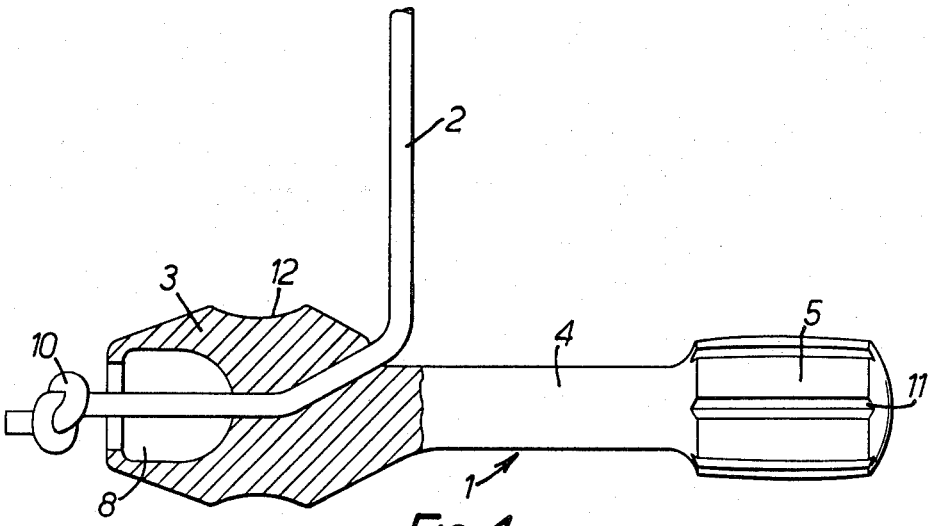
Figure 5:
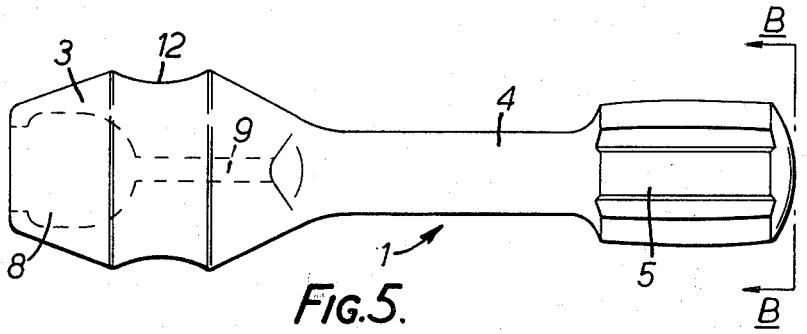
Figure 6:
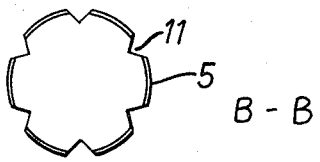
Figure 7A:
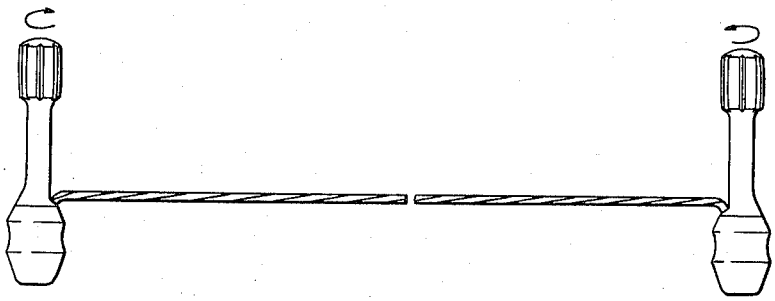
Figure 7B:
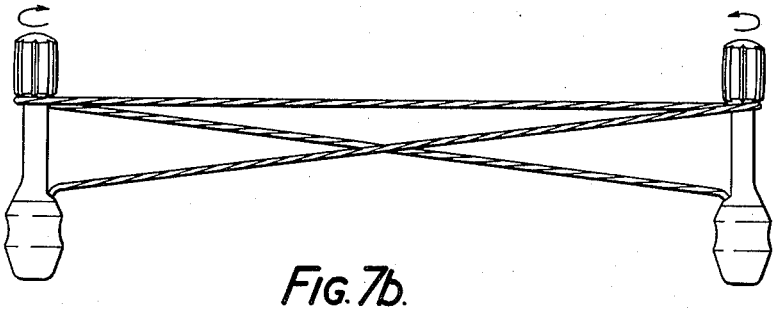
Figure 7C:
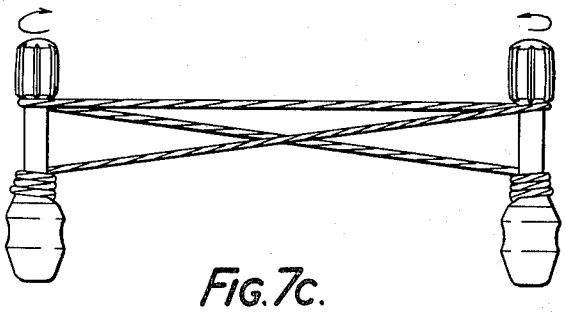

The invention will be further illustrated with reference to the accompanying drawings, where FIG. 1 shows a handle with a rope as seen from the side, FIG. 2 shows a handle with one end piece screwed off, FIG. 3 shows a cross section along the line A—A in FIG. 2, FIG. 4 shows, in partial cross section, a second embodiment of the invention as seen from the side, FIG. 5 shows the embodiment of FIG. 4 as seen from above, an internal cavity in this embodiment being indicated by the dashed lines, FIG. 6 shows a cross section along the line B—B in FIGS. 2 and 5, and FIGS. *7a* to *7c* illustrate possible ways in which the equipment may be used.

FIG. 1 shows a handle 1 comprising a middle section 4 and two sections 3 and 5, with a rope 2 being attached to the middle section 4 of the handle. The rope is preferably attached closely adjacent to one end section 3 of the handle.

FIG. 2 shows an embodiment in which the end piece 3 can be screwed off from the rest of the handle, the end portion of the middle section 4 and a cavity in the end section 3 being provided with mating threads, 6'' and 6', respectively. In addition, the end of the middle section 4 is provided with a groove or depression 7 for receiving the rope 2, and the cavity in the end section 3 is intended to receive a knotted end of the rope 2 such that the rope will be held securely attached to the handle when the end piece 3 has been screwed onto the middle section.

FIG. 4 shows a preferred embodiment of the invention, wherein the middle section 4 and the end pieces 3 and 5 are made in one piece and wherein a cavity 8 and a channel 9 provided in the end piece 3 serve to receive the rope, which also in this case is secured and retained by means of a knot 10 in the rope.

Preferably, the end section 3 has a larger diameter than the end section 5 and is also provided with a recess 12 intended to receive and support the little finger of the user's hand during use, while the end piece 5 is preferably provided with longitudinal flutes 11 to facilitate a firm grip of the other fingers.

FIGS. *7a* to *7c* illustrate the simple manner in which the device can be adjusted to suit the individual user, by looping the rope around the handles and thereafter turning the handles, thus enabling the user to vary infinitely the distance between the handles.

Thus, by holding the rope taut and rolling the handles toward or away from each other, the distance between the handles may be extended or shortened. The rope becomes wound around the thinner middle section and thus does not get in the way of the user at a subsequent use of the device. The handles are formed in accordance with the anatomy of the hand and the functioning of the hands and wrists, so that one's grip will not become weakened even under rather heavy strains, and this permits unrestricted movement in all directions.

It is a great advantage that the length of the rope can be regulated according to the user's wishes and possibilities; and especially in exercises to increase the mobility of the joints, where mobility varies from one person to the next, it is essential that each individual be able to adjust the equipment to an optimum degree for his/hers particular condition.

In the same way, the device enables the user to perform movements against varying degrees of resistance. The device of the invention enables one to exercise and train all muscle contractions, both statically and dynamically, and with varying degrees of resistance. At the same time, the device can also be utilized to train one in correct bodily posture and correct lifting techniques. Due to its small size, the equipment according to the invention can be carried around anywhere, and this enables one to perform effective exercise and training even at places of employment where the employees are subjected to one-sided and static strains but where the employees are not able to leave their work location. No special location is required, and the effect of the equipment in use is equally great no matter where it is used. One can oneself determine time and place, and therefore in general obtain a most desirable improvement in one's state of health. Even bedridden individuals and people doing sedentary jobs can use the equipment, and one can also simulate most of the training exercises for sports such as jogging and running, cycling, rowing, breaststroke, freestyle and backstroke swimming, cross-country skiing and slalom skiing. Morever, one can exercise with this device to increase one's speed, mobility, conditioning, strength and suppleness.

Having described my invention, I claim:

1. A gymnastics/exercising device comprising two separate elongated handles each of a length approximately that of a width of a human hand interconnected by means of an inelastic rope by which the length between the handles can be varied, wherein respective ends of the rope are secured to each of said handles at a middle section of the handles, said middle section having a circular cross section of smaller diameter than the end sections of the handle, and wherein one end section has a larger diameter than the other end section and contains a cavity interconnected with a channel means opening from said middle section in which a knotted end of the rope is retained for securing the rope to the handles, so that the length of said rope can be varied by winding the rope around the middle section of each handle to suit the user.

2. A gymnastics/exercising device according to claim 1, wherein said other end section of said handle is provided with longitudinal flutes.

3. A gymnastics/exercising device according to claim 1, wherein said larger diameter end section has a circular recess intended to receive and support the little finger of the user's hand during use of the device.

4. A gymnastics/exercising device according to claim 1, wherein the middle section and said end sections of each handle are made in one piece.

5. A gymnastics/exercising device according to claim 1, wherein said larger diameter end section of the handle is threaded into the middle section.

* * * * *